US008261689B2

(12) United States Patent
Sakakibara et al.

(10) Patent No.: US 8,261,689 B2
(45) Date of Patent: Sep. 11, 2012

(54) STAIN PREVENTING COVER FOR COATING MACHINE

(75) Inventors: Masahito Sakakibara, Toyota (JP); Hisanori Nakamura, Toyota (JP); Youichi Hanai, Toyota (JP); Hideki Saitou, Toyota (JP); Michio Mitsui, Yokohama (JP); Masatoshi Iwase, Yokohama (JP)

(73) Assignees: Toyota Jidosha Kabushiki Kaisha, Toyota-shi, Aichi-ken (JP); Ransburg Industrial Finishing K.K., Kanagawa (JP)

( * ) Notice: Subject to any disclaimer, the term of this patent is extended or adjusted under 35 U.S.C. 154(b) by 321 days.

(21) Appl. No.: 12/599,831

(22) PCT Filed: May 15, 2008

(86) PCT No.: PCT/JP2008/059408

§ 371 (c)(1),
(2), (4) Date: Nov. 12, 2009

(87) PCT Pub. No.: WO2008/143308

PCT Pub. Date: Nov. 27, 2008

(65) Prior Publication Data

US 2010/0212587 A1 Aug. 26, 2010

(30) Foreign Application Priority Data

May 18, 2007 (JP) ..... 2007-132865

(51) Int. Cl.
*B05B 5/025* (2006.01)
*B05B 1/28* (2006.01)

(52) U.S. Cl. ..... 118/621; 118/326; 239/706; 901/49

(58) Field of Classification Search ..... 118/620–640, 118/326; 239/706, 700, 703, 707; 427/427.1, 427/427.2, 483; 901/49
See application file for complete search history.

(56) References Cited

U.S. PATENT DOCUMENTS 7,546,962 B2 * 6/2009 Yamada ..... 239/706

FOREIGN PATENT DOCUMENTS

JP S59-7057 1/1984

(Continued)

OTHER PUBLICATIONS

Extended European Search Report for EP Appl. No. 08753080.4-2425 dated Mar. 24, 2011.

*Primary Examiner* — Yewebdar Tadesse
(74) *Attorney, Agent, or Firm* — Finnegan, Henderson, Farabow, Garrett & Dunner, LLP

(57) ABSTRACT

The stain preventing cover is formed from a composite sheet 24 having a three layer structure as a raw material which is produced by laminating a first sheet material 21 having a low dielectric constant and having insulation performance, a second sheet material 22 having a dielectric constant higher than that of the first sheet material 21 or having semiconductivity and a third sheet material 23 having a dielectric constant lower than that of the second sheet material 22 and having insulation performance, in which an end of the second sheet material 22 is positioned together with an end of the first and third sheet materials 21 and 23 adjacent to a electrostatic high voltage part 10 of a coating machine and another end thereof is positioned distant from an earth part 11 of the coating machine to be electrically insulated. The influence of the disturbance of the electric potential distribution on the surface of a coating machine main body 5 is alleviated by the first and second sheet materials 21 and 22 to cause the electric potential distribution on the surface of the third sheet material 23 to be homogeneous to thereby preventing the attaching of atomized coating particles to the surface.

3 Claims, 2 Drawing Sheets

FOREIGN PATENT DOCUMENTS

| | | |
|---|---|---|
| JP | 4-74555 | 3/1992 |
| JP | 8-332418 | 12/1996 |
| JP | 2004-136625 | 5/2004 |
| WO | WO 2007-015335 | 2/2007 |

* cited by examiner

STAIN PREVENTING COVER FOR COATING MACHINE

CROSS-REFERENCE TO RELATED APPLICATIONS

This application is a national phase application of International Application No. PCT/JP2008/059408, filed May 15, 2008, and claims the priority of Japanese Application No. 2007-132865, filed May 18, 2007, the contents of both of which are incorporated herein by reference.

TECHNICAL FIELD

The present invention relates to a stain preventing cover covering the surface of a coating machine for electrostatic coating.

BACKGROUND ART

The electrostatic coating is a coating method by applying a high voltage to a rotating atomizer head of a coating machine to charge negatively atomized coating particles and by causing an object to adsorb onto the coating particles through electrostatic force while causing the object to serve as a positive electrode, which is excellent in coating efficiency, so that it is frequently used in the coating of an automobile body, or the like.

And now, in such an electrostatic coating, a part of atomized coating particles scattered circumferentially is attached to the surface of the coating machine and when they are left as they are, they drip down from the coating machine during the coating and become a cause for degrading the coating quality. Therefore, at a certain time interval, a cleaning process for cleaning a stain of the coating machine becomes necessary. However, for performing the cleaning of the coating machine, the operation is necessary to be stopped and depending on the case, the coating machine should be detached from a coating robot, so that the coating is stopped during that time and the productivity becomes sacrificed.

Then, conventionally generally, the stain of the coating machine has been dealt with only by covering the coating machine with a cover and by exchanging the cover. In this case, as a material of the cover, for intending to suppress the attaching of the atomized coating particles as much as possible, resin having high insulation performance is frequently used. However, partially, the use of a semi-conductive resin is attempted (see Patent Document 1).

[Patent Document 1]

Japanese Patent Application Publication No. JP-A-4-74555

DISCLOSURE OF THE INVENTION

Problem to be Solved by the Invention

However, when the above-described cover is covered on a coating machine, there is a problem that such a phenomenon, in which the attaching of the atomized coating particles to the cover is progressed depending on a site of the coating machine, is caused and then, the cover should be exchanged significantly frequently, so that the productivity cannot be enhanced as expected.

The present invention has been completed by taking into consideration the above technical background and the task thereof is to provide a stain preventing cover for a coating machine for contributing largely to the enhancement of the productivity by suppressing the attaching of the atomized coating particles to the whole cover for preventing the stain to reduce the frequency of exchanging the cover.

Means for Solving the Problem

While the present inventors have made extensive and intensive studies on the partial attaching phenomenon of atomized coating particles to the cover, they have been led to such a conclusion that a cause of the phenomenon is such that a disturbance of the electric potential distribution on the surface of the coating machine influences on the cover and the potential difference on the surface of the cover becomes heterogeneous. In other words, the main body of the coating machine is made of insulating resins and on the surface of the coating machine main body, there is such an electric potential distribution that the highest potential is in the side of the rotating atomizer head and the lowest potential is in the side of connection with a coating robot (earth side). However, inside the coating machine, not only a motor (air motor, electric motor) for rotating the rotating atomizer head and a high voltage generator for generating a high voltage applied to the rotating atomizer head are built in, but also an air path, a coating material path, or the like are provided. Therefore, it is assumed that the electric potential distribution on the surface of the coating machine during the coating is complicated such that a part of high potential difference and a part of low potential difference are mixed, which influences on the cover, so that a partial attaching of the atomized coating particles is progressed.

The present invention has been completed based on the above findings and a stain preventing cover for covering the surface of an electrostatic coating machine is produced from a composite sheet as a raw material which is formed by laminating a first sheet material having a low dielectric constant and having insulation performance, a second sheet material having a dielectric constant higher than that of the first sheet material or having semiconductivity and a third sheet material having a dielectric constant lower than that of the second sheet material and having insulation performance. Thus, by producing such a 3-layer laminate structure, even when the disturbance of the electric potential distribution exists on the surface of the coating machine, the influence of the disturbance is alleviated by the first sheet material of a lower layer and the second sheet material of a middle layer, and the electric potential distribution on the surface of the third sheet material of an upper layer becomes homogeneous, so that a partial attaching phenomenon of the atomized coating particles to the cover becomes suppressed.

Exemplary Form of the Invention

Hereinafter, some aspects of the present invention are exemplified and these aspects are described by itemizing them.

(1) A stain preventing cover for covering the surface of an electrostatic coating machine produced from a composite sheet as a raw material which is formed by laminating a first sheet material having a low dielectric constant and having insulation performance, a second sheet material having a dielectric constant higher than that of the first sheet material or having semiconductivity and a third sheet material having a dielectric constant lower than that of the second sheet material and having insulation performance, in which the first sheet material is formed so as to be positioned inside of the cover; and an end of the second sheet material is positioned close to or connected to an electrostatic high voltage part of the coating machine and another end thereof is positioned distant from an earth part of the coating machine.

In the stain preventing cover described in the present item (1), by disposing the first sheet material having a low dielectric constant and having insulation performance at the side of the coating machine, even when a disturbance of the electric potential distribution exists on the surface of the coating machine, the influence thereof is alleviated to some extent by the first sheet material. In addition, by laminating the second sheet material having a high dielectric constant or having semiconductivity on the first sheet material and by positioning the resultant laminate distant from the earth part to electrically-insulate it, high potentials are distributed on the surface of the second sheet material, so that the influence of the disturbance of the electric potential distribution is largely alleviated. Further, by laminating the third sheet material having a low dielectric constant and having insulation performance on the second sheet material, the electric potential distribution on the surface of the third sheet material becomes homogeneous (the potential difference is homogeneous) and as a result, the attaching of the atomized coating particles to the whole stain preventing cover is suppressed.

(2) The stain preventing cover for a coating machine according to the above item (1), in which another end part of the second sheet material is positioned distant from the earth part by notching the another end of the second sheet material to retreat it from the end face of the first and third sheet materials.

In the stain preventing cover according to the item (2), by notching another end part of the second sheet material to retreat it, the another end of the second sheet material can be easily positioned distant from the earth part.

(3) The stain preventing cover for a coating machine according to the item (1) or item (2), in which the first and third sheet materials are made of polyethylene tetrafluoride and the second sheet material is made of polyurethane.

In the present invention, though a type of a material of each sheet is any type of material, as the invention according to the item (3), when polyethylene tetrafluoride as a material of the first and third sheet materials and semiconductive polyurethane as a material of the second sheet material, respectively, are selected, the materials are easily available and the production becomes easy.

Effects of the Invention

By the stain preventing cover for a coating machine according to the present invention, the attaching of the atomized coating particles to the whole cover can be suppressed, so that the frequency of exchanging the cover can be reduced, which contributes largely to the enhancement of the productivity.

DESCRIPTION OF THE REFERENCE NUMERALS

Figure 1:
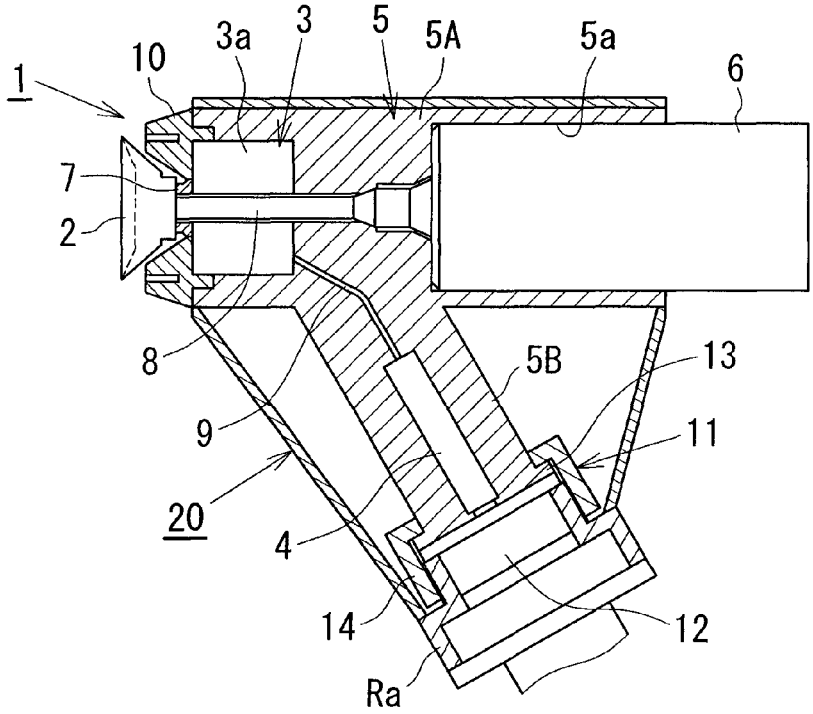
FIG. 1 is a sectional view showing a fitted state of a stain preventing cover according to the present invention in a coating machine and the structure of the coating machine.

1 Coating machine
2 Rotating atomizer head
3 Air motor
4 High voltage generator
5 Coating machine main body
6 Coating material cartridge
10 Shaping air discharge ring (electrostatic high voltage part)
11 Connection part of coating machine with robot (earth part)
20 Stain preventing cover
21 First sheet material
22 Second sheet material
23 Third sheet material
24 Composite sheet
Ra Wrist part of robot

BEST MODES FOR CARRYING OUT THE INVENTION

Hereinafter, best modes for carrying out the present invention are described referring to the attached drawings.

Figure 2:
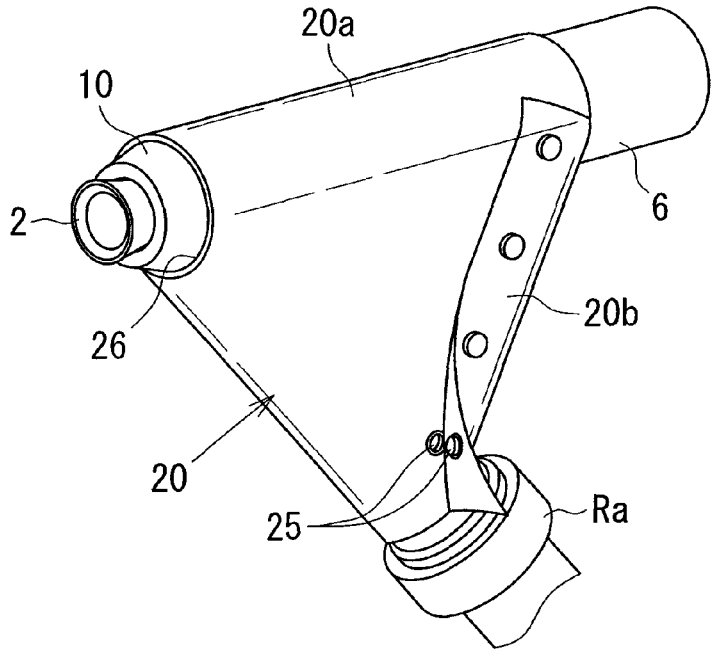
FIG. 2 is a perspective view showing a general configuration of the present stain preventing cover and a fitted state thereof in the coating machine.
Figure 3:
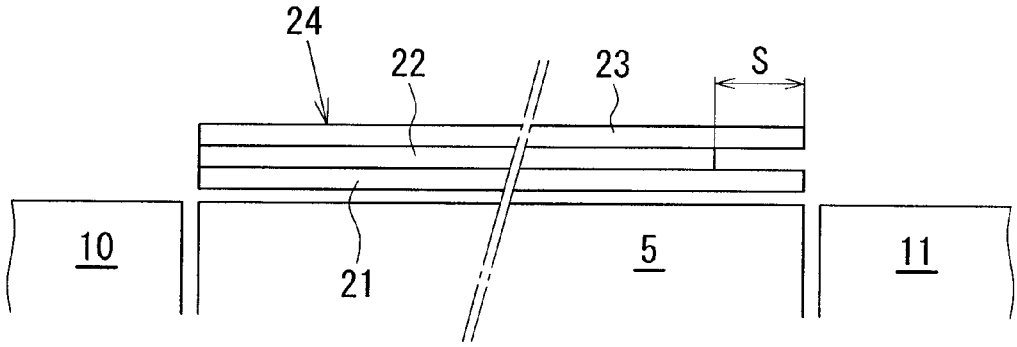
FIG. 3 is a schematic view showing a laminating structure of sheet materials constituting the present stain preventing cover.

FIGS. 1 to 3 show one embodiment of the stain preventing cover according to the present invention. In these drawings, 1 represents a coating machine for electrostatic coating and 20 represents the stain preventing cover according to the present invention for covering the coating machine 1. The coating machine 1 is substantially constituted with a coating machine main body 5 having built-in a rotating atomizer head 2, an air motor 3 for rotationally driving the rotating atomizer head 2 and a high voltage generator 4 for generating a high voltage applied to the rotating atomizer head 2; and a coating material cartridge 6 serving as a feed source of a coating material fed to the rotating atomizer head 2, and the stain preventing cover 20 covers the whole coating machine main body 5. In addition, there also is a coating machine in which an electric motor is used for rotation driving of the rotating atomizer head 2, and the present invention can be applied to such a coating machine.

The coating machine main body 5 here includes a power department 5A folding the air motor 3 and a high voltage generating part 5B folding the high voltage generator 4 which is positioned intersecting with the power department 5A, and the whole body thereof is composed of an insulating resin. The rotating atomizer head 2 is attached to a tip part of a hollow rotating axis 7 extending from the air motor 3 and inside the rotating atomizer head 2, a tip part of a feed tube 8 inserted through the hollow rotating axis 7 and extended from the coating material cartridge 6 is introduced. A part of the coating material cartridge 6 is folded in a concave portion 5*a* formed in a rear end part of the power department 5A of the coating machine main body 5 and is in this state attached to and detached from the coating machine main body 5 utilizing a negative pressure introduced to the bottom of the concave portion 5*a*. The coating material cartridge 6 has built-in a piston driven by a fluid pressure and a coating material in the coating material cartridge 6 is fed through the feed tube 8 to the rotating atomizer head 2 corresponding to an action of the piston.

A casing 3*a* of the air motor 3 is made of a metal and to the casing 3*a*, an electrostatic high voltage (as one example: −90 kV) is supplied from the high voltage generator 4 through an internal cable 9. The casing 3*a* of the air motor 3 and the rotating atomizer head 2 are connected to each other through the metal-made hollow rotating axis 7 and an electrostatic high voltage supplied to the casing 3*a* is applied to the rotating atomizer head 2 as it is. In addition, at the tip of the power department 5A of the coating machine main body 5, a shaping air discharge ring 10 for discharging a shaping air to the surrounding of the rotating atomizer head 2 is provided. This ring 10 here is made of a metal and is provided juncturally to the casing 3*a* of the air motor 3, by which also to the ring 10, an electrostatic high voltage is applied through the casing 3*a* of the air motor 3, and accordingly, this shaping air discharge ring 10 serves as an electrostatic high voltage part in the coating machine 1.

Figure 4:
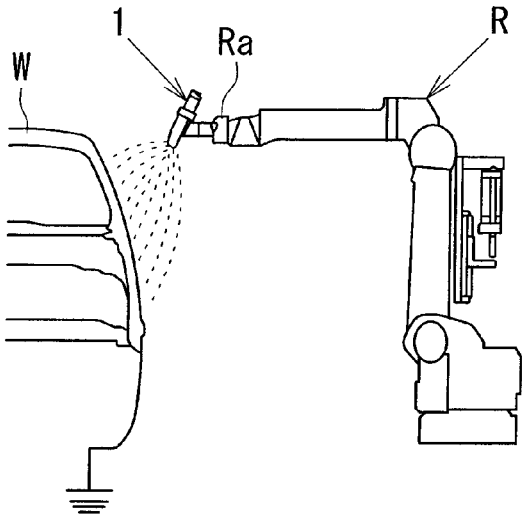
FIG. 4. is a side view showing an embodying situation of an embodiment of the present invention performed to an objective automobile body.

On the other hand, an end part of the high voltage generating part 5B of the coating machine main body 5 serves as a connection part 11 with a wrist part Ra of a coating robot R shown in FIG. 4. In more detail, the end part of the high voltage generating part 5B and the wrist part Ra of the coating robot R are butted to each other through a metal-made end plate 12. And in this state, by screwing a nut 14 latched together with an end flange part 13 of the high voltage generating part 5B with the wrist part Ra, the coating machine 1 is designed to be coupled with the wrist part Ra of the coating robot R. In the end plate 12, besides an end connection leading to an air path for sending air to the air motor 3, an end connection for supplying an electric power to the high voltage generator 4, an end connection for sending a fluid for driving a piston to the coating material cartridge 6, an end connection leading to a negative pressure path for sending a negative pressure into the concave part 5*a* folding the coating material cartridge 6, or the like are provided and for coupling the coating machine 1 with the wrist part Ra, to the each end connection, each corresponding piping is connected. The body of the coating robot R is earthed, by which the connection part 11 including the end plate 12 and the wrist part Ra serves as an earth part.

As shown in FIG. 3, the stain preventing cover 20 according to the present invention is formed from a composite sheet 24 having a 3 layer structure as a raw material which is produced by laminating a first sheet material 21 ($10^{12}$ to $10^{20}\Omega\cdot$cm) having a low dielectric constant and having insulation performance, a second sheet material 22 ($10^{6}$ to $10^{11}\Omega\cdot$cm, more preferably $10^{9}$ to $10^{11}\Omega\cdot$cm) having a dielectric constant higher than that of the first sheet material 21 or having semiconductivity and a third sheet material 23 ($10^{12}$ to $10^{20}\Omega\cdot$cm) having a dielectric constant lower than that of the second sheet material 22 and having insulation performance. Each of the sheets 21 to 23 is bonded to each other with an adhesive therebetween and the stain preventing cover 20 is formed in such a manner that the first sheet material 21 comes inside. In the present embodiment, as the first and third sheet materials 21 and 23, polyethylene tetrafluoride ($10^{18}\Omega\cdot$cm) is, as the second sheet material 22, semiconductive polyurethane ($10^{11}\Omega\cdot$cm) is, respectively selected. In addition, each of the sheets 21 to 23 has any plate thickness in a range of 0.1 to 1.0 mm. In this case, the plate thicknesses of each of the sheets 21 to 23 may be the same as or different from each other.

As shown in FIG. 2, the present stain preventing cover 20 (hereinafter, referred to as only the cover 20) includes a main body part 20*a* molded in a triangular-hat form and a flexible door part 20*b* for blocking the opening of the main body part 20*a*. On the outer surface of the opening part of the main body part 20*a* and the inner surface of the door part 20*b*, a plurality of hooks 25 latchable-unlatchable to each other is provided, and by closing the door part 20*b* using the hooks 25, the present cover 20 becomes a triangular bag shape as the whole. In addition, it is needless to say that the hooks 25 may be exchanged to other latch-unlatch means such as a hook-and-loop fastener.

In the top of the main body part 20*a* constituting the present cover 20, a hole 26 through which the tip part of the coating machine 1 including the rotating atomizer head 2 and the shaping air discharge ring 10 can be inserted is formed. For fitting the cover 20 to the coating machine 1, the cover 20 in which the door part 20*b* is open is covered on the coating machine 1 and the tip part of the coating machine 1 is caused to project from the hole 26, followed by closing the door part 20*b* using the hooks 25. Thus, the whole coating machine main body 5 is covered with the cover 20 and as shown in FIGS. 1 and 3, one end (at an opening edge of the hole 26) of the composite sheet 24 forming the cover 20 is positioned adjacent to the shaping air discharge ring 10 serving as an electrostatic high voltage part, as well as another end thereof is positioned adjacent to the connection part 11 serving as the earth part.

On the other hand, in the side of the other end of the composite sheet 24 positioned adjacent to the connection part 11 serving as the earth part, as shown in FIG. 3, the second sheet material 22 of a middle layer is notched by a predetermined width S. In other words, the other end of the second sheet material 22 is positioned distant from the connection part 11 serving as the earth part and thus, the second sheet material 22 is electrically insulated. In addition, the width S has, for example a size of around 2 cm.

When an electrostatic coating is performed using the coating machine 1, while applying an electrostatic high voltage generated by the high voltage generator 4 to the rotating atomizer head 2 through the casing 3*a* of the air motor 3, the rotating atomizer head 2 is rotated by the air motor 3 at a high speed and a coating material is fed to the rotating atomizer head 2 from the coating material cartridge 6. Then, the coating material is atomized by the rotating atomizer head 2 and the resultant atomized coating material is charged negatively and flies toward an object to be coated which is set to be a positive electrode to be adhered to the object to be coated by an electrostatic force.

In the above electrostatic coating, on the surface of the coating machine main body 5, there exists a electric potential distribution in which the highest potential is in the side of the shaping air discharge ring 10 serving as an electrostatic high voltage part (the side of the rotating atomizer head 2) and the lowest potential is in the side of the connection part 11 with the coating robot R serving as the earth part. However, the electric potential distribution does not become homogeneous due to the influences of the built-in air motor 3 and the high voltage generator 4, so that only by covering an insulating or semiconductive cover on the coating machine as described above, the attaching of the atomized coating particles to the cover is progressed depending on the site, the cover should be significantly frequently exchanged.

However, in the present embodiment, since the cover 20 is formed with the composite sheet 24 as a raw material which is produced by laminating three sheet materials 21 to 23 having different electric properties, the influence of the disturbance of the electric potential distribution on the surface of the coating machine main body 5 is alleviated and the electric potential distribution on the surface of the third sheet material 23 of upper layer becomes homogeneous, so that a partial attaching phenomenon of atomized coating particles to the cover 20 is suppressed. In more detail, by disposing the first sheet material 21 having a low dielectric constant and having insulation performance in the side of the coating machine main body 5, even when there exists the disturbance of the electric potential distribution on the surface of the coating machine, the influence thereof is alleviated to some extent by the first sheet material 21. In addition, since the laminate produced by laminating the second sheet material 22 having a high dielectric constant and having semiconductivity on the first sheet material 21 is positioned distant from the connection part 11 with the coating robot R serving as the earth part to be electrically insulated, high potentials are distributed on the surface of the second sheet material 22 and the influence of the disturbance of the electric potential distribution is further alleviated. In addition, since the third sheet material 23 having a low dielectric constant and having insulation performance is laminated on the second sheet material 22, the electric potential distribution on the surface of the third sheet material 23 becomes homogeneous (the potential difference is homogeneous). Thus, the attaching of atomized coating particles to the whole cover 20 is suppressed and as a result, the frequency of exchanging the cover 20 is reduced, and the productivity is enhanced by just that much.

[First Embodiment]

As shown in FIG. 4, while causing the coating robot R installed in the coating line of an automobile body W to hold the coating machine 1 covered with the present stain preventing cover 20, a metallic coating (electrostatic coating) was performed to an objective automobile body W running on the line under a condition that the rotation number of the rotating atomizer head 2 was 25,000 rpm and the coating material discharge rate was 250 to 300 mL/min, and the coating time until the exchange of the cover 20 became necessary was measured. In addition, for reference, while covering a cover (reference cover) formed from a sheet material (having a plate thickness of 1.0 mm) made of polyethylene tetrafluoride on the coating machine 1, a metallic coating was performed in substantially the same manner as that in the above metallic coating. As a result, it could be confirmed that while in the case of the present stain preventing cover 20, the exchange of the cover was not necessary until 8 hours of the coating time were passed, in the case of the reference cover, the exchange was necessary after 2 hours of the coating time, so that the present cover exhibits large effect for preventing a stain of the coating machine.

The invention claimed is:

1. A stain preventing cover for covering a surface of an electrostatic coating machine produced from a composite sheet as a raw material which is formed by laminating a first sheet material having a low dielectric constant and having insulation performance, a second sheet material having a dielectric constant higher than that of the first sheet material or having semiconductivity and a third sheet material having a dielectric constant lower than that of the second sheet material and having insulation performance, wherein the first sheet material is formed so as to be positioned inside of the cover; and an end of the second sheet material is positioned close to or connected to an electrostatic high voltage part of the coating machine and another end thereof is positioned distant from an earth part of the coating machine;

the second sheet material is made of polyurethane, and the stain preventing cover is fitted to a power department of the electrostatic coating machine.

2. The stain preventing cover for a coating machine according to claim 1, wherein another end part of the second sheet material is positioned distant from the earth part by notching the another end of the second sheet material to retreat it from the end face of the first and third sheet materials.

3. The stain preventing cover for a coating machine according to claim 1, wherein the first and third sheet materials are made of polyethylene tetrafluoride.

* * * * *